US006039659A

United States Patent [19]

Hamm

[11] Patent Number: 6,039,659

[45] Date of Patent: Mar. 21, 2000

[54] INTERCHANGEABLE SHAFT GOLF CLUB

[76] Inventor: Jack Hamm, 11190 E. Cimmarron Dr., Englewood, Colo. 80111

[21] Appl. No.: 09/136,124

[22] Filed: Aug. 18, 1998

Related U.S. Application Data

[60] Provisional application No. 60/056,802, Aug. 25, 1997.

[51] Int. Cl.[7] ..... A63B 53/02

[52] U.S. Cl. ..... 473/306; 473/307; 473/308

[58] Field of Search ..... 473/305, 306, 473/307, 308, 309, 310, 239, 316, 322

[56] References Cited

U.S. PATENT DOCUMENTS

| | | | |
|---|---|---|---|
| 1,544,489 | 6/1925 | Slazenger | 473/306 |
| 1,665,811 | 4/1928 | Hadden | 473/306 |
| 2,129,068 | 9/1938 | Reach | 473/306 |
| 3,170,691 | 2/1965 | Pritchard | 473/306 |
| 3,682,516 | 8/1972 | Savage | 473/306 X |
| 3,819,181 | 6/1974 | Mills | 473/306 |

*Primary Examiner*—Kien T. Nguyen
*Attorney, Agent, or Firm*—Swanson & Bratschun LLC

[57] ABSTRACT

An interchangeable shaft golf club assembly includes a golf club head including an internally threaded hosel. A golf club shaft of a select length and stiffness has external threads about a first end and is threadably engaged with the internally threaded hosel. An internally threaded farrel threadably receives the first end of the shaft and is rotated into threaded abutment with the distal end of the hosel to secure the first end of the shaft within the hosel. The external threads about the first end of the shaft are provided by a cylindrical externally threaded connector axially receiving a first end of the shaft and being adhered thereto.

7 Claims, 2 Drawing Sheets

INTERCHANGEABLE SHAFT GOLF CLUB

RELATED APPLICATIONS

This application claims priority from U.S. Provisional Patent Application Ser. No. 60/056,802, filed Aug. 25, 1997, entitled Interchangeable Shaft Golf Club.

BACKGROUND OF THE INVENTION

1. Technical Field

The present invention is directed toward golf clubs, and more particularly toward an interchangeable shaft golf club assembly.

2. Background Art

In playing the game of golf it is extremely important to the success of a player that the clubs and shafts he or she uses conform to his or her size and physical talents. Golf club manufacturers typically offer only a limited number of club head designs having desired features, such as perimeter weighting and the like, and the clubs are customized to the player by variation in the club shafts. Club shafts typically come in a variety of lengths and stiffness. When a player is fitted to a new set of clubs, the golf professional tests the player's swing to determine an appropriate shaft length and shaft stiffness based upon the player's height and the club head speed the player can generate. The appropriate shaft is then permanently mounted to the club head.

While the conventional method of permanently attaching club heads to club shafts serves well a player who is not changing in physical size or the speed at which he or she is able to propel a club head, this method of attachment provides no flexibility to golfers whose physical size or ability is changing. For example, as a child is growing both in height and strength he or she may need new clubs each year in order to have shafts of appropriate length and stiffness. Because the heads are intended to be permanently affixed to the end of the club shafts, this typically means that the player must replace the entire golf club even though the heads are still perfectly suited to the player's game. Similarly, as a person ages, the club head speed he or she can generate often diminishes, making a more flexible shaft desirable. Again, however, the permanent attachment of club head and shaft often make it necessary for the golfer to replace his or her entire set of clubs while only the shafts actually need replacement.

The present invention is intended to overcome one or more of the problems discussed above.

SUMMARY OF THE INVENTION

An interchangeable shaft golf club assembly includes a golf club head including an internally threaded hosel. A golf club shaft of a select length and stiffness has external threads about a first end and is threadably engaged with the internally threaded hosel. An internally threaded farrel threadably receives the first end of the shaft and is rotated into threaded abutment with the distal end of the hosel to secure the first end of the shaft within the hosel. The external threads about the first end of the shaft may be provided by a cylindrical externally threaded connector axially receiving a first end of the shaft and being adhered thereto by, for example, a two part epoxy. The ferrule preferably includes opposing flats on its outer surface for engagement by a wrench so that the farrel can be brought into and out of forcible abutment with the distal end of the hosel by use of the wrench.

The interchangeable shaft golf club assembly of the present invention enables golf club shafts of varying length or stiffness to be readily exchanged to so as to accommodate different players or a player as his or her physical size or ability evolve. In this manner, a club head, which is typically the most expensive portion of the golf club, can be used again and again with a variety of shafts. The interchangeable shaft golf club assembly has particular appeal for use with junior golfers who are typically growing at a rate that requires new shafts on a yearly basis. The threaded connection to the club hosel is accomplished by a simple adaptation of a conventional golf club shaft through use of the externally threaded connector. Finally, the internally threaded ferrule provides a sure way for "locking" the club head to the end of the shaft to virtually eliminate the possibility of the club head becoming inadvertently disengaged from the shaft.

DETAILED DESCRIPTION OF THE PREFERRED EMBODIMENT

Figure 1:
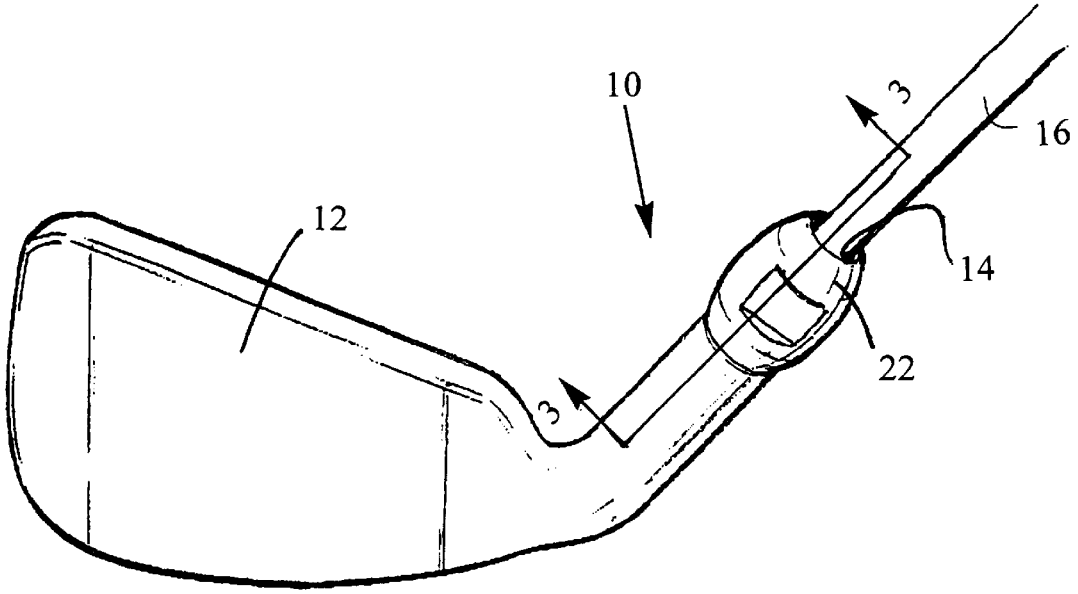
FIG. 1 is a perspective view of an interchangeable golf club assembly in accordance with the present invention.
Figure 2:
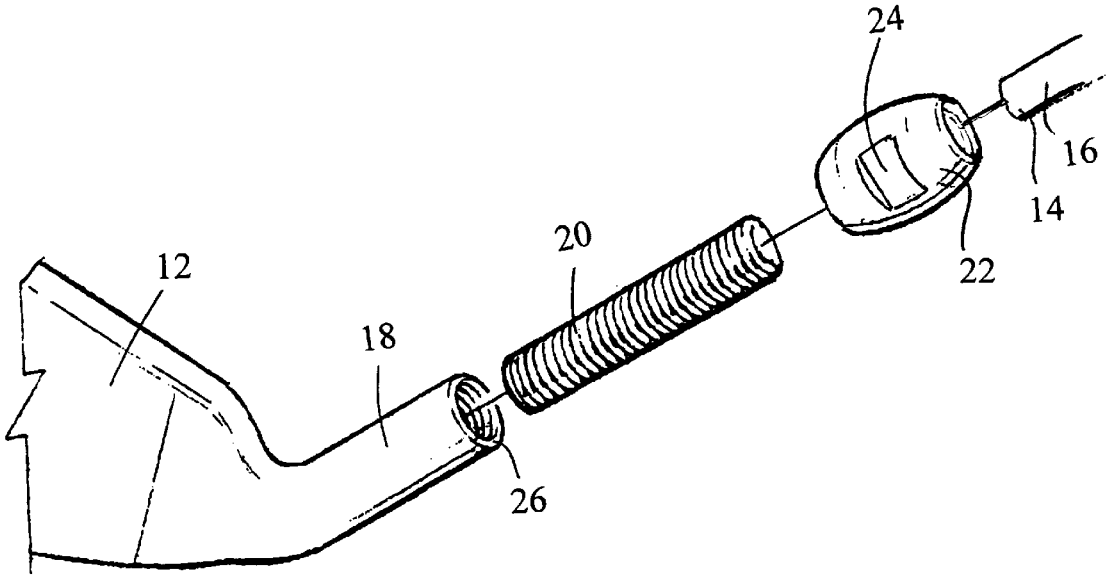
FIG. 2 is an exploded view of the interchangeable golf club assembly of FIG. 1.

An interchangeable shaft golf club assembly 10 is shown in its assembled state in FIG. 1. Visible to a user is the golf club head 12 secured to the first end 14 of a golf club shaft 16. The components which make up the interchangeable shaft golf club assembly 10 are best viewed in FIG. 2. The golf club head 12 includes an internally threaded hosel 18. A cylindrical externally threaded connector 20 has an outer diameter and threading configured to be threadably engaged within the internally threaded hosel 18. The inner diameter of the cylindrical externally threaded connector 20 is slightly greater than the outer diameter of the first end 14 of the shaft 16 so that the first end of the shaft can be axially received within the inner diameter of the externally threaded connector. An internally threaded ferrule 22 has an inner diameter dimensioned to threadably engage the outside of the cylindrical externally threaded connector 20. The internally threaded ferrule includes a pair of opposing flats 24. Preferably, all the threads are "reverse threads" on a right-handed club head and "standard threads" on a left-handed club head. In this manner, the threaded connection between the club and shaft is urged tighter each time a ball is stuck.

The ferrule 22 has a "barrel" profile to increase its mass. A typical ferrule is less than 1 gram. The ferrule 22, which is made of steel, has a mass of 15 grams.

Figure 3:
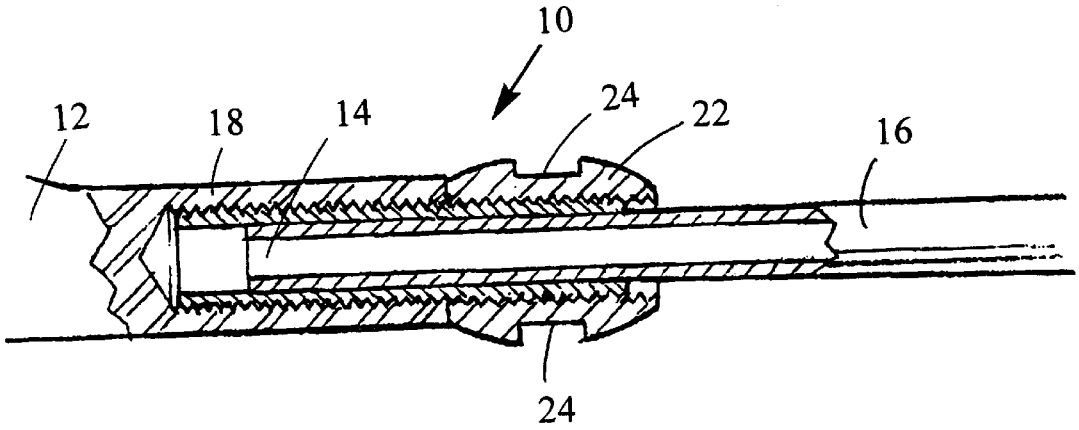
FIG. 3 is a cross-section taken along line 3—3 of FIG. 1.

The construction of the interchangeable shaft golf club assembly 10 is best illustrated in FIG. 3. The distal end 14 of the shaft 16 is matingly received within the inner diameter of the cylindrical externally threaded connector 20, which is preferably made of steel. In a preferred form an adhesive such as a two part epoxy adheres the first end of the shaft 16 within the inner diameter of the cylindrical externally threaded connector 20. The shaft 16 may be graphite, fiberglass or any other suitable composite. Alternatively, the shaft may be metal such as aluminum or steel. Metal shafts may themselves be externally threaded, eliminating the need for the connector 20. The internally threaded ferrule 22, which preferably is made of steel, is threadably engaged with the cylindrical externally threaded connector 20. Next, the first end 14 of the shaft 16 is secured within the internally threaded hosel 18 of the club head 12 by threaded engagement of the cylindrical externally threaded connector 20 within the internally threaded hosel 18. In order to secure the threaded connection between the hosel and the cylindrical externally threaded connector 20, the internally threaded ferrule 22 is threaded into locking abutment with the distal end 26 of the internally threaded hosel 18. Sufficiently tight abutment to insure the club head will not become loose can be obtained by engaging the flats 24 with a conventional wrench and applying suitable torque.

Figure 4:
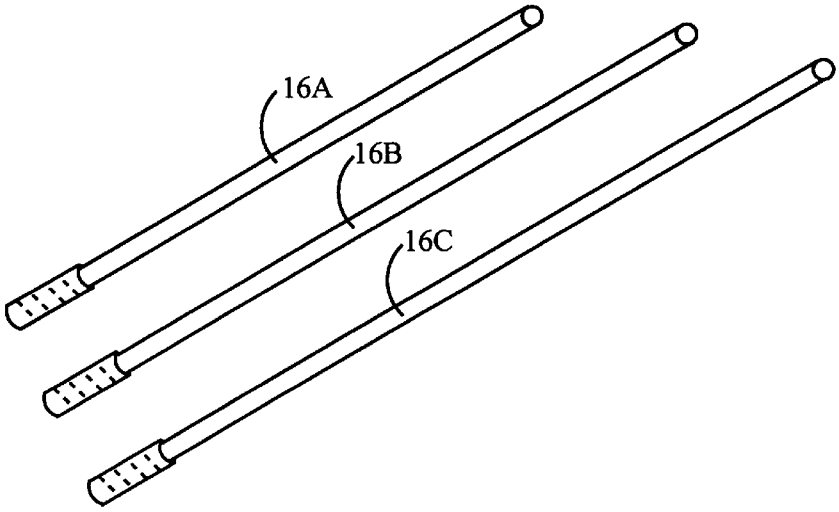
FIG. 4 is a perspective view of a variety of interchangeable golf club shafts in accordance with the present invention having distinct lengths.

A variety of shafts 16A–16C having distinct lengths and stiffnesses (see FIG. 4) can be provided so that golf clubs can be assembled to accommodate virtually any size and skill level player. The only modification to a conventional shaft that is required is provision of a cylindrical externally threaded connector 20 adhered to the first end of the shaft. No special tools other than a conventional wrench are required to replace the shafts. Thus, the interchangeable shaft golf club assembly of the present invention provides an inexpensive modification to readily available club heads and shafts which allows for ready interchangeability of the shafts to accommodate different sized and skilled golfers. The barrel ferrule 22 also provides a unique advantage. Between the threaded connector 20, which has a mass of 5 grams, and the barrel ferrule 22, which has a mass of 15 grams, 20 grams are added to the shaft in close proximity to the club head. This added weight alters the moment of inertia of the club bringing the center of gravity up the club shaft slightly. This feature provides a greater total mass striking a ball at a select velocity, improving driving distance. Moreover, the increased mass helps players "throw" the club head through a ball while striking it, further enhancing driving distance.

What is claimed is:

1. An interchangeable shaft golf club assembly comprising:

a club head, the club head including an internally threaded hosel; and a club shaft of a select length and stiffness, the club shaft having external threads operatively associated therewith about a first end threadably engaging the internally threaded hosel; and an internally threaded ferrule threadably receiving the external threads associated with the first end of the shaft and being threaded into abutment with a distal end of the hosel to secure the first end of the shaft within the hosel.

2. The interchangeable shaft golf club assembly of claim 1 further comprising a plurality of club shafts of varying length or stiffness having external threads operatively associated therewith about a first end sized for threaded engagement with the threaded hosel.

3. The interchangeable shaft golf club assembly of claim 1 wherein the club shaft further comprises a cylindrical externally threaded connector axially receiving and affixed to the first end of the shaft, the cylindrical externally threaded connector providing the external threads operatively associated with the first end of the shaft.

4. The interchangeable shaft golf club assembly of claim 1 wherein the internally threaded ferrule includes opposing flats on its outer surface for engagement by a wrench, whereby the ferrule can selectively be brought into and out of forcible abutment with the distal end of the hosel by use of the wrench.

5. The interchangeable shaft golf club assembly of claim 1 wherein the ferrule has a barrel configuration to increase its mass.

6. An interchangeable shaft golf club assembly comprising:

a club head, the club head including an internally threaded hosel;

a club shaft of a select length and stiffness;

a cylindrical externally threaded connector axially receiving and affixed to a first end of the shaft, the connector threadably engaging the threaded hosel; and an internally threaded ferrule threadably receiving the threaded connector and being threaded into abutment with a distal end of the hosel to secure the first end of the shaft within the hosel.

7. The interchangeable shaft golf club assembly of claim 6 wherein the internally threaded barrel ferrule includes opposing flats on its outer surface.

* * * * *